US006364038B1

(12) United States Patent
Driver

(10) Patent No.: US 6,364,038 B1
(45) Date of Patent: Apr. 2, 2002

(54) DOWNHOLE FLEXIBLE DRIVE SYSTEM

(76) Inventor: W B Driver, Apt 3, 8701 Calmont Ave., Fort Worth, TX (US) 76116

( * ) Notice: Subject to any disclaimer, the term of this patent is extended or adjusted under 35 U.S.C. 154(b) by 0 days.

(21) Appl. No.: 09/553,935

(22) Filed: Apr. 21, 2000

(51) Int. Cl.[7] ..... E21B 4/02; E21B 7/04

(52) U.S. Cl. ..... 175/95; 175/61; 175/100; 175/101; 175/107

(58) Field of Search ..... 175/61, 73, 95, 175/100, 101, 104, 107, 320

(56) References Cited

U.S. PATENT DOCUMENTS 1,850,403 A * 3/1932 Lee
3,999,901 A * 12/1976 Tschirky ..... 418/18
4,007,797 A * 2/1977 Jeter ..... 175/26
4,143,722 A * 3/1979 Driver ..... 175/95
4,227,584 A * 10/1980 Driver ..... 175/95
4,732,223 A * 3/1988 Schoeffler et al. ..... 175/73
RE33,660 E * 8/1991 Jelsma ..... 175/107
5,135,059 A * 8/1992 Truner et al. ..... 175/101
5,667,023 A * 9/1997 Harrell et al. ..... 175/45
5,727,641 A * 3/1998 Eddison et al. ..... 175/76
6,234,259 B1 * 5/2001 Kukes et al. ..... 175/73

* cited by examiner

*Primary Examiner*—David Bagnell
*Assistant Examiner*—Jennifer R. Dougherty

(57) ABSTRACT

Improvements for a downhole flexible drive system for drilling high angle well holes or curved holes from the vertical to the horizontal with an ultra short radius to drill a horizontal drain hole. The improvements include a flexible shaft that connects the drive train of the system to a swivel joint attached inside the uphole tool joint of the system, that provide the drive train of the system the capability to carry part or all the tension loads on the system. An exhaust collar is provided with deflectors that direct excess drilling fluid up a well hole. A pump section is provided to insure drilling fluid flow over the face of a drill bit and the transport of cuttings. To increase flexibility and limit the length of inflexible sections of the system, a flexible tube to carry drilling fluids connects the bearing pack to the system. A flexible shaft connects the associated drive shaft of the bearing pack to the system for the transmission of torque to a drill bit tool joint

1 Claim, 3 Drawing Sheets

DOWNHOLE FLEXIBLE DRIVE SYSTEM

CROSS REFERENCE TO RELATED APPLICATIONS

See U.S. Pat. No. 4,227,584; 4,143,722 and their cited references.

BACKGROUND OF THE INVENTION

The field of invention relates to downhole fluid or electrical motors used to drill vertical well holes, horizontal drain holes from vertical well holes and high angle directional wells.

PRIOR ART

Present directional drilling systems when only using regular drill pipe for drilling of horizontal holes or high angle holes from a vertical well can only deviate from the vertical a few degrees per hundred feet and to drill a curved hole from the vertical to the horizontal requires the radius of the curved hole to be several hundred feet. The use of downhole motors has reduced the radius of bend of the curved hole from the vertical to the horizontal but they are not as effective as they should be because of their long length The long length of the downhole motors restricts their use around curved holes with small radius of bend. So a downhole flexible drive system is need to operate around ultra short radiuses of bend.

SUMMARY OF THE INVENTION

It is an objective of the invention to provide improvements to downhole flexible drive system, particularly to the downhole flexible drive systems indicated in the cross reference to related application above.

It is an objective of the invention to provide a downhole flexible drive system which can be attached to the downhole end of a drill pipe string and operate a drill bit to drill a curved hole with an ultra short radius of bend.

It is an objective of the invention to provide a downhole flexible drive system powered by an assembly of short fluid double shaft motors.

It is an objective of the invention for the assembly of doubled shaft motors be assemble in line end to end and interfaced with a flexible shaft connecting to the shaft of the double shaft motors and a flexible tube connecting the ends of the flexible motors.

It is an objective of the invention to provide a double shaft pump in the drive train of the downhole flexible drive system to insure fluid flow through and over the face of a drill bit.

It is an objective of the invention to provide a means for the drive train of the downhole flexible drive system to carry part or all the tension loads on the system.

It is an objective of the invention to provide a means for some of the fluid driving the double shaft motor to be exhausted and directed back up the well hole with out going through the drill bit.

DESCRIPTION OF THE DRAWING

In the accompanying drawing.

Figure 1:
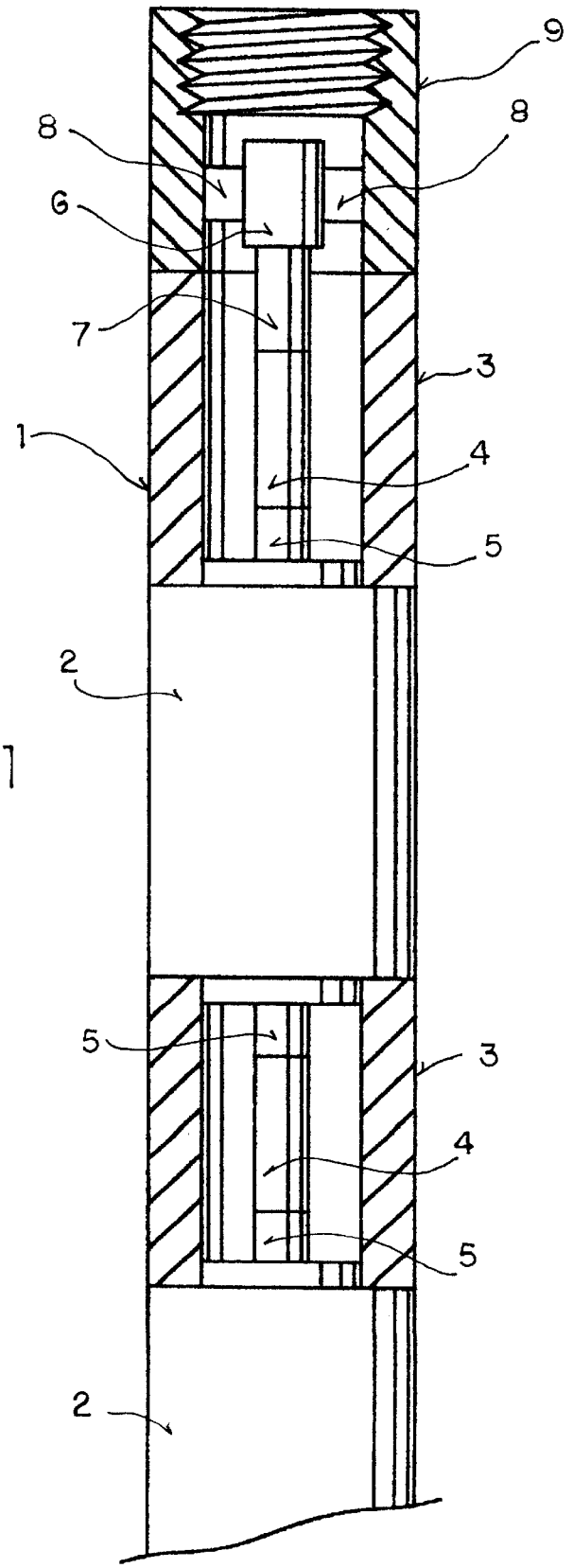
FIG. 1 Illustrate the uphole end portion of the downhole flexible drive system.

Reference Numerals in the Drawings;

1. downhole flexible drilling system
2. short fluid double shaft motor
3. flexible tube
4. flexible shaft
5. motor shaft
6. swivel joint
7. swivel joint shaft
8. swivel joint support
9. attaching tool joint
10. shaft extension
11. double shaft fluid pump
12. pump double shaft
13. exhaust collar
14. exhaust port
15. deflector
16. bit drive shaft
17. flow port
18. bearing housing
19. bearing pack
20. drive shaft port
21. bit tool joint
22. drill bit
23. extend side

DESCRIPTION OF THE PREFERRED EMBODIMENT

Figure 3:
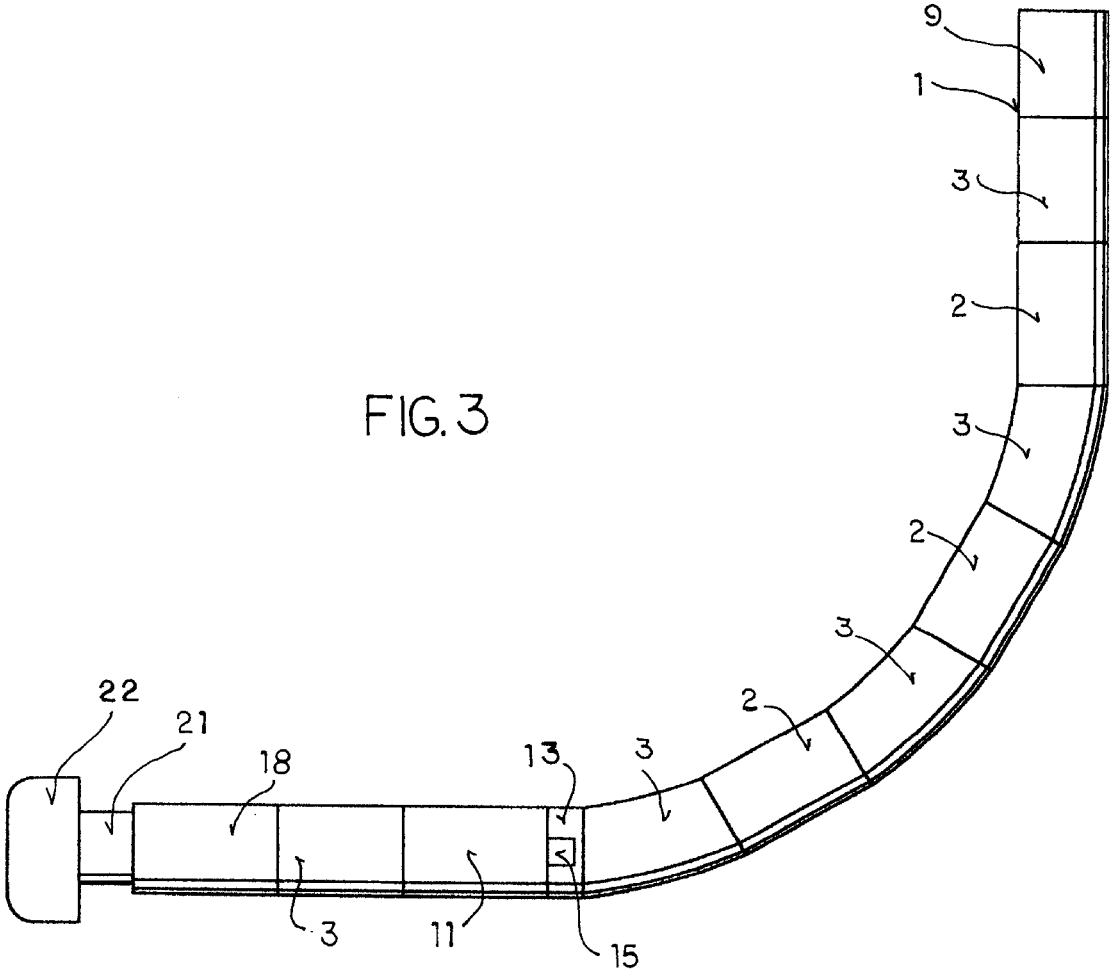
FIG. 3 illustrate the overall view of the downhole flexible drilling system.

The downhole flexible drive system 1 is powered by a plurality of short fluid motors 2 that have a double shaft 5. The plurality of fluid motors are assembled end to end with a flexible shafts 4 attaching the double shafts 5 between the respective fluid motors interfaces in the assembly. Flexible tubes 3 are connected to the ends of the fluid motors 2 enclosing the flexible shafts 4 and provides a means for drilling fluids to be pumped through and powering the fluid motors 2. See FIG. 1 and FIG. 3. A flexible tube 3 connects the uphole end of the uphole fluid motor 2 of the assembly of fluid motors 2 to the downhole end of attaching tool joint 9. A flexible shaft 4 attaches the double shaft 5 of the uphole fluid motor 2 to the swivel joint shaft 7 of swivel joint 6. Swivel joint 6 is attached to the inside of attaching tool joint 9 by swivel joint supports 8. See FIG. 1. Swivel joint supports 8 attach to the inside wall of attaching tool joint 9 and attach to swivel joint 6 holding swivel joint 6 in the center of tool joint 9.

Figure 2:
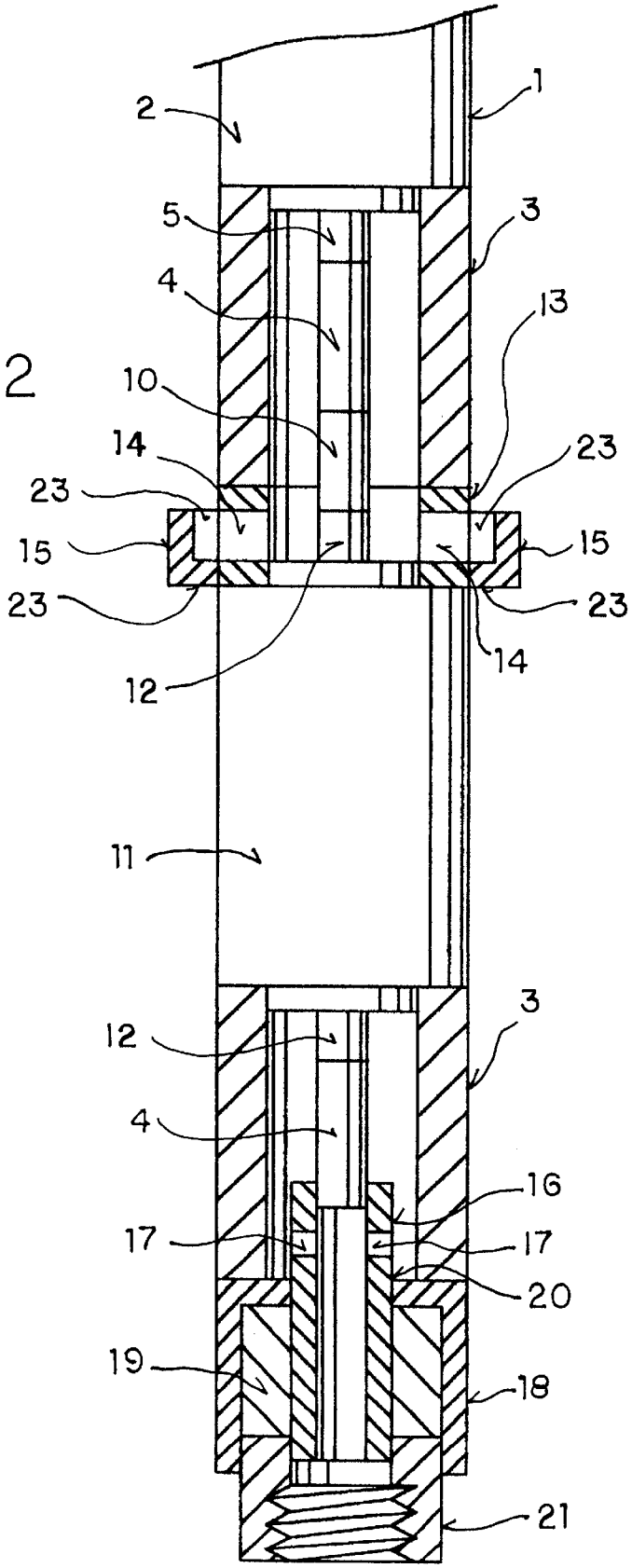
FIG. 2 illustrate the downhole end portion of the downhole flexible drilling system.

A flexible tube 3 attaches from the downhole end of the fluid motor 2 on the downhole end of the assembly of the plurality of fluid motors 2 to the uphole end of exhaust collar 13 see FIG. 2. The downhole end of exhaust collar 13 is attached to the uphole end of a cylinder shaped fluid pump 11 that has a double shaft 12. The uphole end of double shaft 12 is attached to shaft extension 10 that is attached to a flexible shaft 4 that is attached to the downhole end of the double shaft 5 of the fluid motor 2 on the downhole end of the plurality of assembled fluids motors 2. A flexible tube 3 attaches from the downhole end of fluid pump 11 to the uphole end of cylinder shaped bearing housing 18. See FIG. 2. Bearing housing 18 encloses bearing pack 19. The uphole end of bearing housing 18 is closed except for drive shaft port 20 located in the center of the uphole end of bearing housing 18 and is large enough for hollow drive shaft 16 to operate through. The downhole end of bearing housing 18 is open so bit tool joint 21 can extend into bearing housing 18 and interface with bearing pack 19.

A flexible shaft 4 attaches to the downhole end of double shaft 12 and extends into and attaches to hollow drive shaft 16. Hollow drive shaft 16 extends through drive shaft port

20 through bearing pack 19 and extends into and attaches to the inside of bit tool joint 21. Bit tool joint 21 attaches the downhole flexible drive system to drill bit 22. See FIG. 3.

Flow ports 17 are through the side of hollow drive shaft 16 between where the flexible shaft 4 attached to the inside of hollow drive shaft 16 and the drive shaft port 20 in the top of bearing housing 18. See FIG. 2.

Exhaust ports 14 are in the side of exhaust collar 13. Square shaped deflector 15 with three extend sides 23 are attached over the exhaust ports 14 so the open side of deflector 15 will be on the uphole side of exhaust port 14 so drilling fluids being exhausted through the exhaust ports 14 would be directed uphole Directing the drilling fluids uphole would keep the drilling fluids from being exhausted directly against the wall of the hole being drilled which could cause problems in maintaining the integrity of the hole being drilled, particularly in soft formations.

The bit tool joint 21, hollow drive shaft 16, flexible shafts 4, double shaft 12, shaft extension 10 double shafts 5, swivel shaft 7 form the drive train of the downhole flexible drive system 1. This drive train is attached by swivel joint 6 and swivel joint supports 8 to the attaching tool joint 9 and can carry part or all the tension loads on the downhole flexible drive system 1. Since the drive train can carry part or all the tension loads on the downhole flexible drive system this will provide greater flexibility in the design of the flexible tube 3 and will significantly increase the utilization of the downhole flexible drive system 1.

The exhaust ports 14 are provided so there will not be any restrictions on the flow of drilling fluids to power the fluid motors 2 which might be the case if all the drilling fluids have to pass through the drill bit 22. The pump 11 is provide to insure there will be enough drilling fluid flow through the drill bit 22 to cool the drill bit 22 and transport the cutting into the flow of the drilling fluids moving uphole from the exhaust ports 14. Also the use of the flexible sections provided the use of the flexible tube 3 with the flexible shaft 4 between all nonflexible elements not retorting except the pump 11 exhaust collar interface increase the overall flexibility of the downhole flexible drive system 1.

I claim:

1. A downhole flexible drive system that provides a drive train that can carry part or all the tension loads on said system and provide flexibility for said system for drilling a curved hole with an ultra short radius, said system consisting of an assembled plurality of double shaft fluid motors interfaced end to end with flexible sections comprising flexible tubes and flexible shafts, the flexible tubes connect the respective ends of the said fluid motors and the flexible shafts connect the ends of the double shaft of said motors, said flexible tubes enclose the said flexible shafts and provide a means for drilling fluids to be pumped through the said system, said flexible shafts transmit the accumulated torque of said fluid motors, a flexible tube connects the uphole end of an uphole fluid motor on the uphole end of the said plurality to the downhole end of an attaching tool joint, a swivel joint, two or more swivel joint supports, a flexible shaft connects the uphole end of the double shaft of said uphole fluid motor to a swivel joint shaft of said swivel joint attached in the center of said attaching tool joint by two or more said supports attached to the inside wall of the said attaching tool joint and attached to the said swivel joint, a downhole fluid motor on the downhole end of the said plurality, a flexible tube connects the downhole end of said downhole fluid motor to the uphole end of an exhaust collar, the downhole end of said exhaust collar connects to the uphole end of a cylinder shaped fluid pump that has a double shaft, the end of the double shaft of said fluid pump attaches to a shaft extension that attaches to a flexible shaft that connects to the downhole end of the double shaft of the said downhole fluid motor, a flexible tube connects the downhole end of the said fluid pump to the uphole end of a cylinder shaped bearing pack housing, said bearing pack housing encloses a bearing pack, the uphole end of said bearing pack housing is closed except for a drive shaft port in the center of the uphole end of said bearing pack housing, the downhole end of said bearing pack housing is open so a drill bit tool joint can extend into the said bearing pack housing and interface with the said bearing pack, a flexible shaft attaches to the downhole end of said double shaft of said downhole fluid pump and extends into and attaches inside of a hollow drive shaft, said hollow drive shaft extends from the end portion of said attaching flexible shaft through said drive shaft port, through said bearing pack into and attaches to the uphole end of said drill bit tool joint, two or more flow ports are through the side of said hollow drive shaft between where said flexible shaft attaches and said drive shaft port, two or more exhaust ports through the side of said exhaust collar, a square shaped deflector with three extended sides and one open side are attached over said exhaust ports with said open side of said deflector on the uphole side of said exhaust ports so exhausted drilling fluids exiting through the exhaust ports can be directed up a well hole.

* * * * *